US010557312B2

(12) United States Patent
Andersen

(10) Patent No.: US 10,557,312 B2
(45) Date of Patent: Feb. 11, 2020

(54) DOWNHOLE OPERATIONAL TOOL

(71) Applicant: WELLTEC A/S, Allerød (DK)

(72) Inventor: Tomas Sune Andersen, Allerød (DK)

(73) Assignee: Welltec A/S, Allerød (DK)

( * ) Notice: Subject to any disclaimer, the term of this patent is extended or adjusted under 35 U.S.C. 154(b) by 5 days.

(21) Appl. No.: 15/615,112

(22) Filed: Jun. 6, 2017

(65) Prior Publication Data

US 2017/0350193 A1 Dec. 7, 2017

(30) Foreign Application Priority Data

Jun. 7, 2016 (EP) ..... 16173224

(51) Int. Cl.
*E21B 43/112* (2006.01)
*E21B 10/32* (2006.01)
(Continued)

(52) U.S. Cl.
CPC ..... *E21B 10/322* (2013.01); *E21B 4/003* (2013.01); *E21B 4/02* (2013.01); *E21B 23/01* (2013.01); *E21B 29/005* (2013.01); *E21B 41/0085* (2013.01); *E21B 43/112* (2013.01); *E21B 41/00* (2013.01)

(58) Field of Classification Search
CPC combination set(s) only.
See application file for complete search history.

(56) References Cited

U.S. PATENT DOCUMENTS 2,457,277 A * 12/1948 Schlumberger ..... E21B 43/112 166/55.1
4,354,558 A * 10/1982 Jageler ..... E21B 4/02 173/36

(Continued)

FOREIGN PATENT DOCUMENTS

EP 2 530 238 A1 12/2012
EP 2 574 721 A1 4/2013
EP 2 813 665 A1 12/2014

OTHER PUBLICATIONS

International Search Report and Written Opinion dated Aug. 18, 2017 in International Application No. PCT/EP2017/063709 (10 pages).

*Primary Examiner* — Cathleen R Hutchins
*Assistant Examiner* — Ronald R Runyan
(74) *Attorney, Agent, or Firm* — Nixon & Vanderhye P.C.

(57) ABSTRACT

The present invention relates to a downhole operational tool for moving a tool part between a retracted position and a projected position in a well. The downhole operational tool comprises a tool body having an axial extension; the tool part being movable perpendicularly to the axial extension between the retracted position and the projected position; a projection actuator configured to project the tool part from the tool body by means of hydraulics, the projection actuator comprising an actuator housing and a projection piston configured to slide inside the actuator housing, the tool part being connected with the projection piston; and a retraction actuator comprising a spring element configured to retract the tool part into the tool body, the retraction actuator being connected with the projection piston so that when the projection actuator projects the tool part, the spring element is compressed. The spring element is arranged outside the actuator housing.

13 Claims, 9 Drawing Sheets

Figure 1:
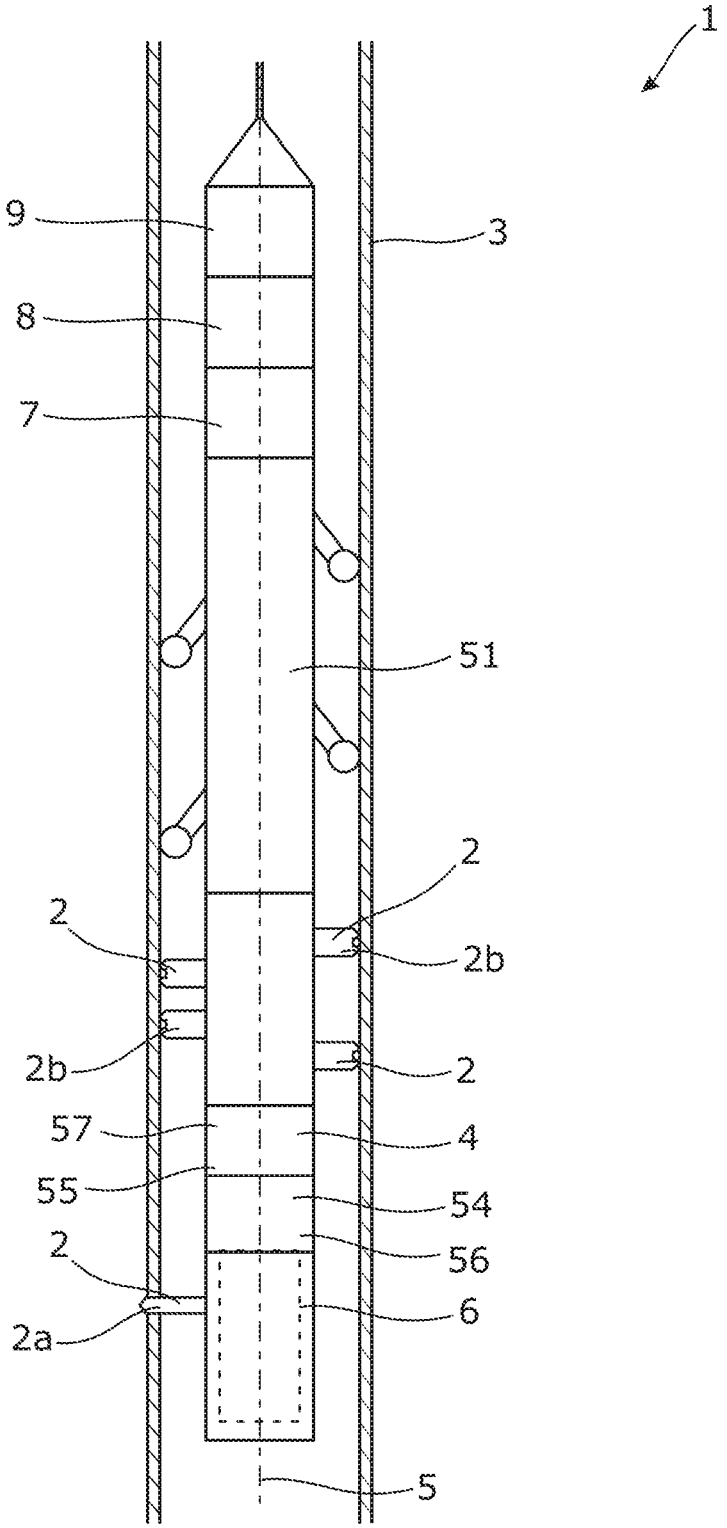

(51) Int. Cl.

| | |
|---|---|
| ***E21B 23/01*** | (2006.01) |
| ***E21B 29/00*** | (2006.01) |
| ***E21B 4/00*** | (2006.01) |
| ***E21B 4/02*** | (2006.01) |
| ***E21B 41/00*** | (2006.01) |

(56) References Cited

U.S. PATENT DOCUMENTS

| | | | | |
|---|---|---|---|---|
| 5,183,111 | A * | 2/1993 | Schellstede | E21B 7/18 166/212 |
| 6,158,529 | A * | 12/2000 | Dorel | E21B 7/067 175/61 |
| 6,164,126 | A * | 12/2000 | Ciglenec | E21B 49/10 166/100 |
| 2002/0063481 | A1 * | 5/2002 | Fukunaga | H02K 41/0356 310/17 |
| 2015/0090454 | A1 | 4/2015 | Pasvandi | |

* cited by examiner

DOWNHOLE OPERATIONAL TOOL

This application claims priority to EP Patent Application No. 16173224.3 filed Jun. 7, 2016, the entire content of which is hereby incorporated by reference.

The present invention relates to a downhole operational tool for moving a tool part between a retracted position and a projected position in a well.

When operating downhole, tool parts extend from the outer face of the tool, however, due to the limited space downhole, the tools are also limited in space. The projection of tool parts is therefore also limited, especially when the tool parts are projected radially from the tool housing by means of hydraulics. This is due to the fact that the hydraulic means used for the projection takes up part of the space, but also due to the fail-safe mechanism which is always capable of retracting the tool part when the power to the tool is interrupted.

Attempts have been made to decentralise the tool in the well, however, the ability to decentralise the tool is not always sufficient for the tool parts to project enough radially outwards to perform a task.

It is an object of the present invention to wholly or partly overcome the above disadvantages and drawbacks of the prior art. More specifically, it is an object to provide an improved downhole operational tool having a tool part with a longer projection distance than prior art tools, the projection distance being the distance by which the tool part extends from the outer face of the tool.

The above objects, together with numerous other objects, advantages and features, which will become evident from the below description, are accomplished by a solution in accordance with the present invention by a downhole operational tool for moving a tool part between a retracted position and a projected position in a well, comprising:

a tool body having an axial extension, the tool part being movable perpendicularly to the axial extension between the retracted position and the projected position, a projection actuator configured to project the tool part from the tool body by means of hydraulics, the projection actuator comprising an actuator housing and a projection piston configured to slide inside the actuator housing, the tool part being connected with the projection piston, and a retraction actuator comprising a spring element configured to retract the tool part into the tool body, the retraction actuator being connected with the projection piston so that when the projection actuator projects the tool part, the spring element is compressed, wherein the spring element is arranged outside the actuator housing.

Also, the retraction actuator may comprise a retraction piston configured to compress the spring element, the retraction piston being connected with the projection piston by means of an elongated element.

Furthermore, the elongated element may be bendable.

Additionally, the downhole operational tool may further comprise a turning point around which the elongated element turns.

Moreover, the elongated element may be a wire, a chain or a strip made of spring metal.

Also, the elongated element may run in a tubular element having a bend, the bend forming the turning point.

In addition, the turning point may be provided by a bearing around which the elongated element turns.

Further, several turning points may be arranged, around which the elongated element turns.

Additionally, the several turning points may be provided with several bearings around which the elongated element turns.

Moreover, the spring element may have a spring axis extending along the axial extension.

Also, the spring element may have a spring axis which is substantially perpendicular to the axial extension.

Furthermore, the spring element may be a coiled spring.

In addition, the tool part may be a drill bit, a machining bit, an arm, an anchor, a key, a punch or a hollow drill.

Moreover, the tool body may have a tool diameter and an outer face, the tool part being capable of projecting at a distance from the outer face, the distance being at least 25% of the tool diameter, preferably at least 30% of the tool diameter, and more preferably at least 50% of the tool diameter.

The downhole operational tool may further comprise a support section having a projectable element for moving the tool body towards an inner face of a casing or towards a borehole of the well, for centralising the tool body in the casing or in the borehole, or for supporting the tool when operating.

Furthermore, the projectable element may be an arm, a wheel arm or an anchor.

Also, the downhole operational tool may further comprise a rotation unit configured to rotate the actuator housing to rotate the tool part.

Moreover, the actuator housing may be shaped as a hollow cylinder.

The actuator housing may have a round and/or circular outer cross-sectional configuration with an oval inner bore matching an oval shape of the projection piston.

By round is meant that every part of the surface or the circumference is equidistant from a centre axis of the actuator housing along the axial extension of the actuator housing.

In addition, the actuator housing may comprise a toothed rim engaging a toothed shaft rotated by the rotation unit.

Also, bearings may be arranged between the actuator housing and the tool body.

Additionally, the elongated element may be fixedly connected to a connection part engaging the projection piston which is configured to rotate in relation to the connection part.

Furthermore, a bearing may be arranged between the connection part and the projection piston.

Moreover, the projection piston may be configured to be rotatable with the actuator housing and slidable therein.

Also, a sealing element may be arranged between the retraction piston and the actuator housing.

Further, a plurality of bearings may be arranged between the actuator housing and the tool body.

In addition, the retraction actuator may comprise a piston housing in which the retraction piston and the spring element are arranged.

Additionally, the retraction piston may divide the piston housing into a first housing part and a second housing part, the first housing part comprising the spring element and the second housing part having an opening which is in fluid communication with the well.

The downhole operational tool may further comprise a measuring unit configured to measure a position of the tool part.

Moreover, the measuring unit may be configured to measure a position of the retraction piston and thereby the position of the tool part.

Furthermore, the measuring unit may be a coil.

The coil may be arranged within the spring element.

Moreover, the retraction piston may have a centre shaft configured to extend into the coil.

The downhole operational tool may further comprise a rotation unit for rotating a first part of the tool in relation to a second part of the tool, the first part comprising the projection actuator and the retraction actuator.

The downhole operational tool may further comprise a driving unit configured to propel the tool forward in the well.

Furthermore, the downhole operational tool may further comprise a detection unit configured to measure a position of the tool in relation to the well.

Finally, the downhole operational tool may further comprise a pump configured to deliver pressurised fluid to the projectable actuator.

Figure 2:
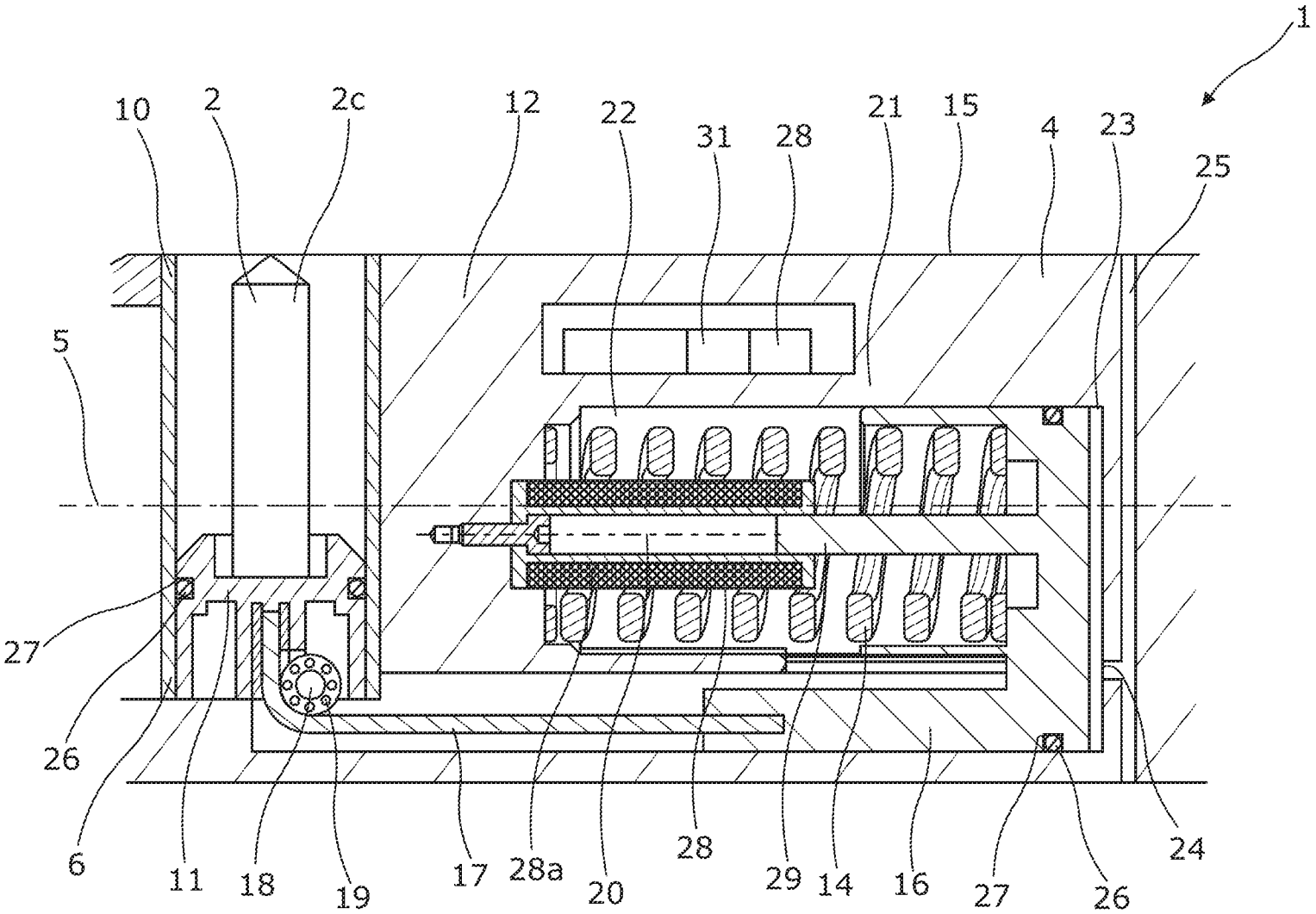
Figure 3:
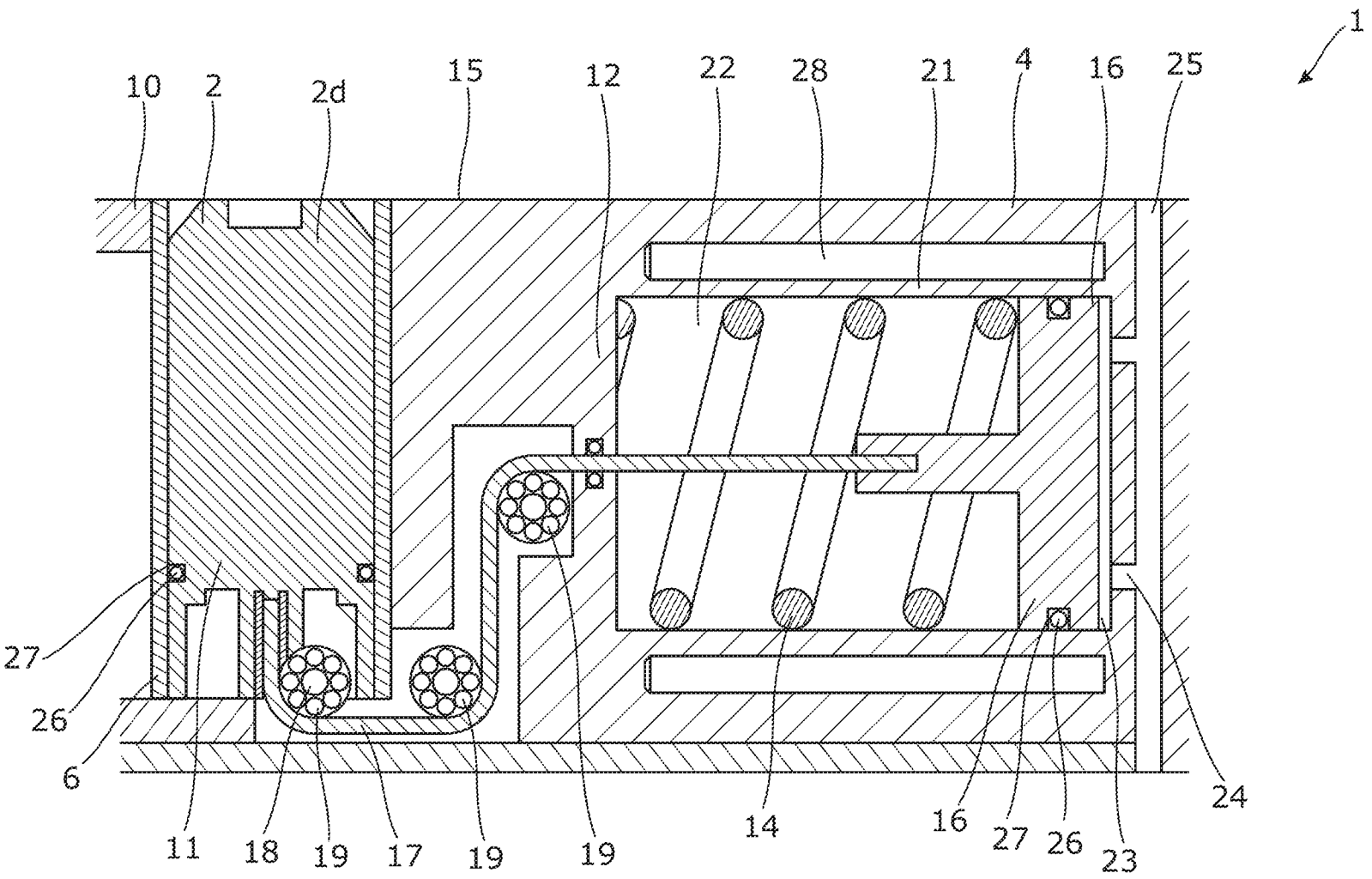
Figure 4:
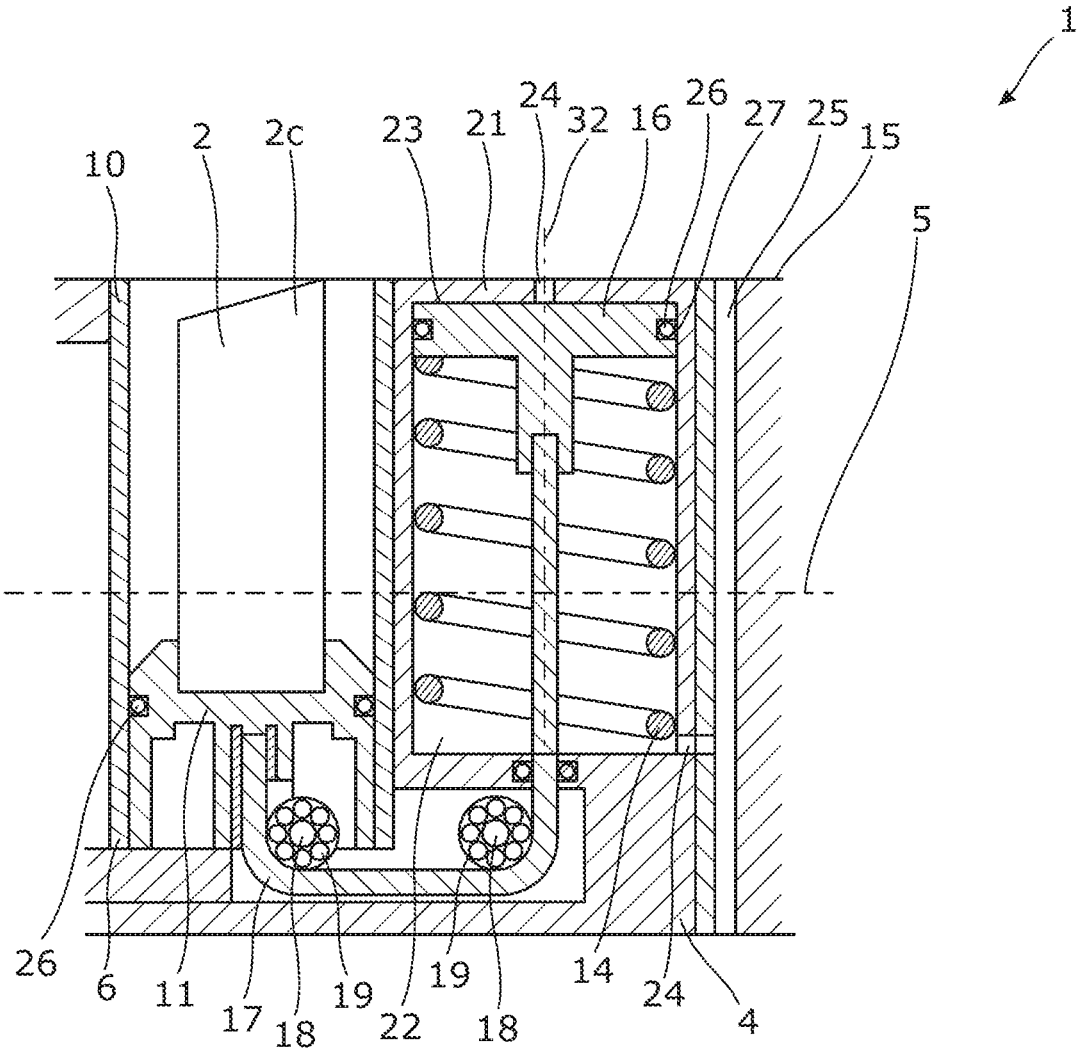
Figure 5:
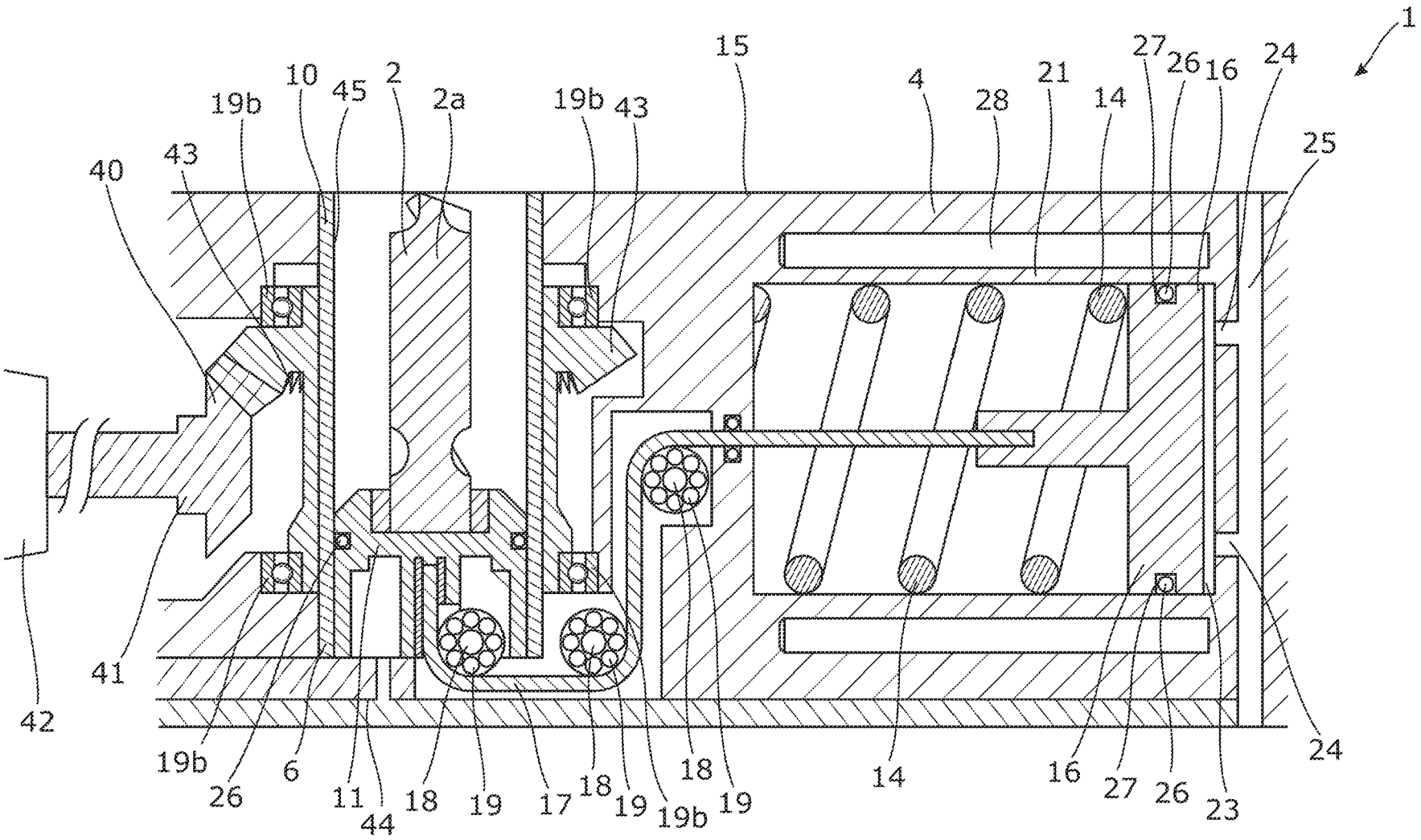
Figure 6:
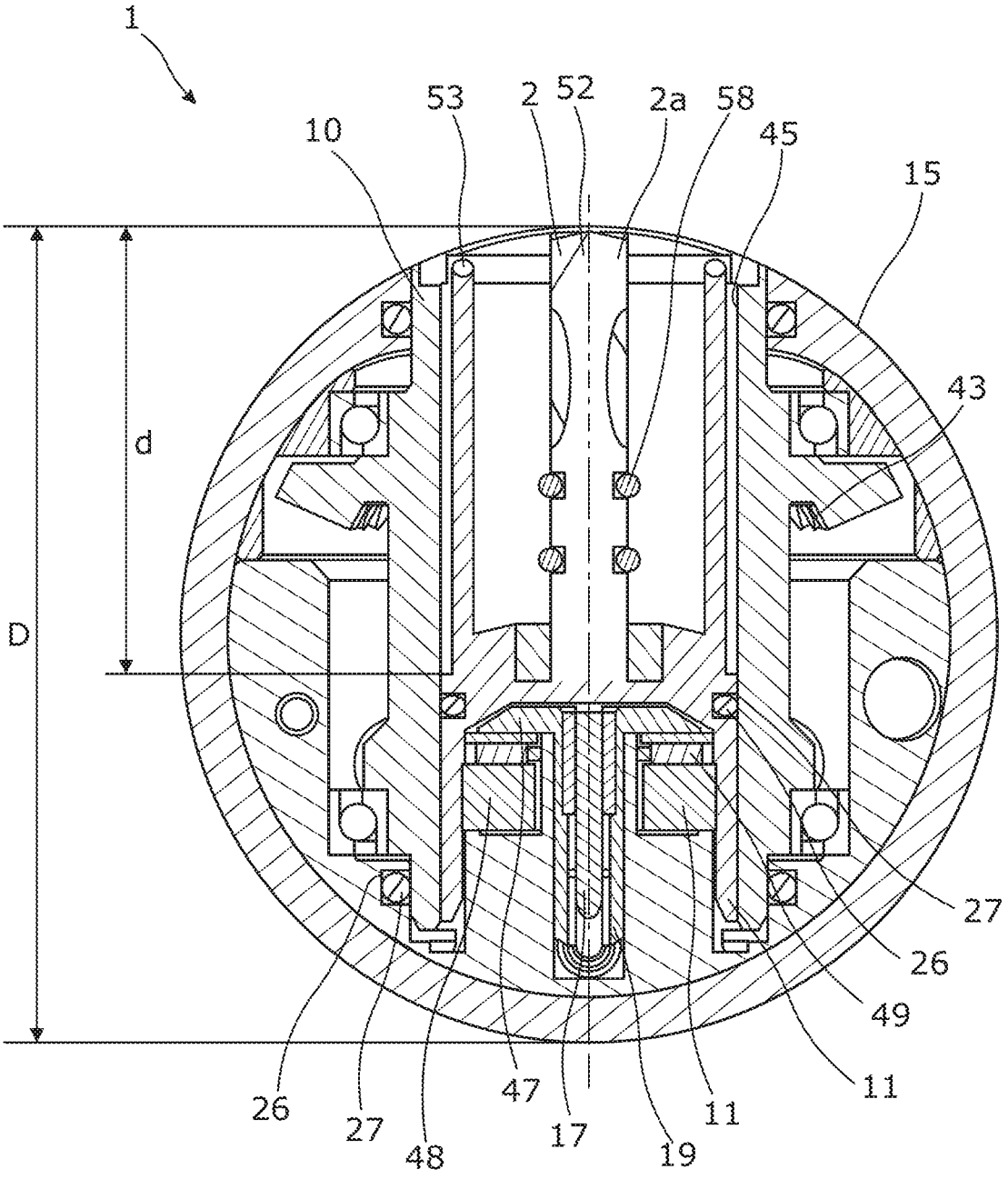
Figure 7:
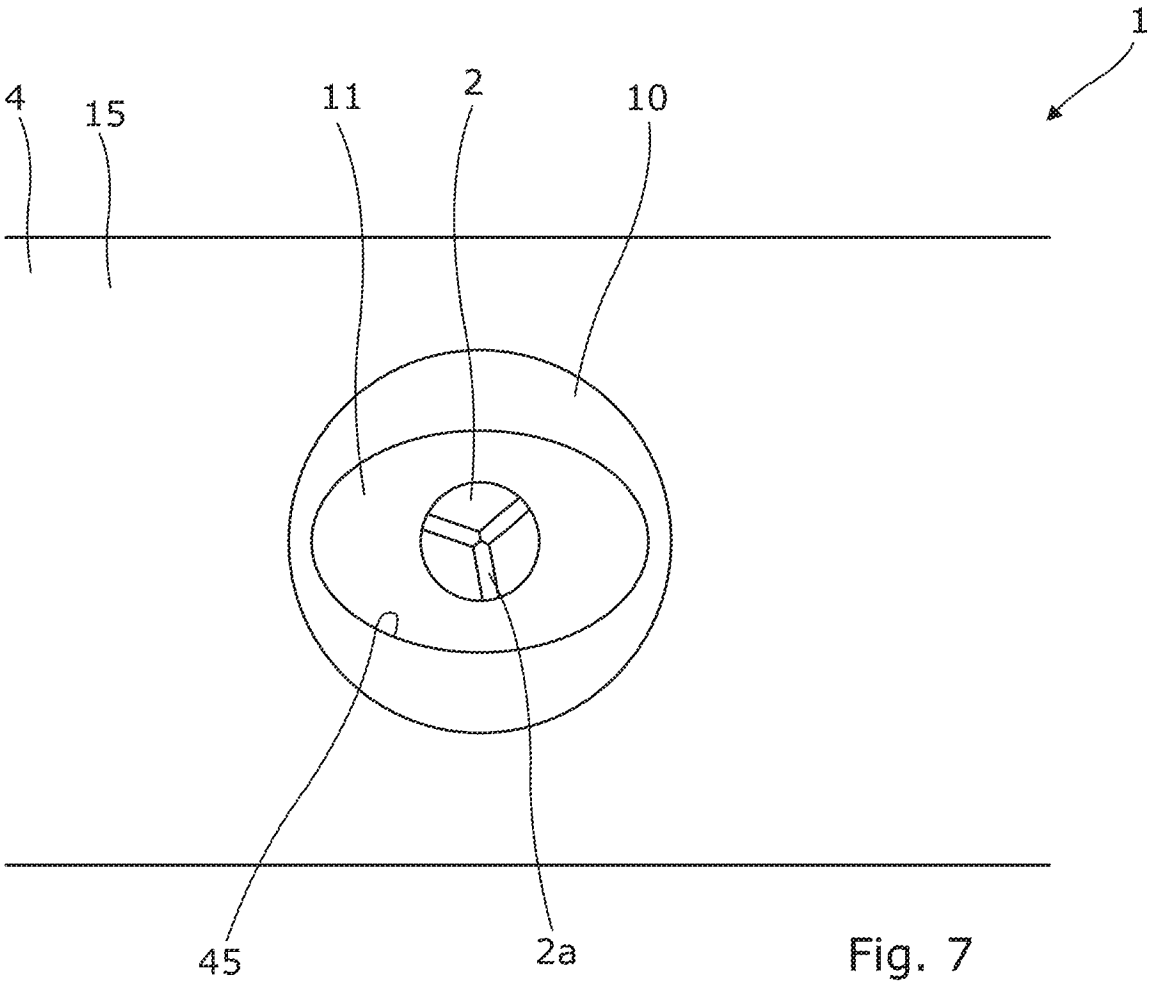
Figure 8:
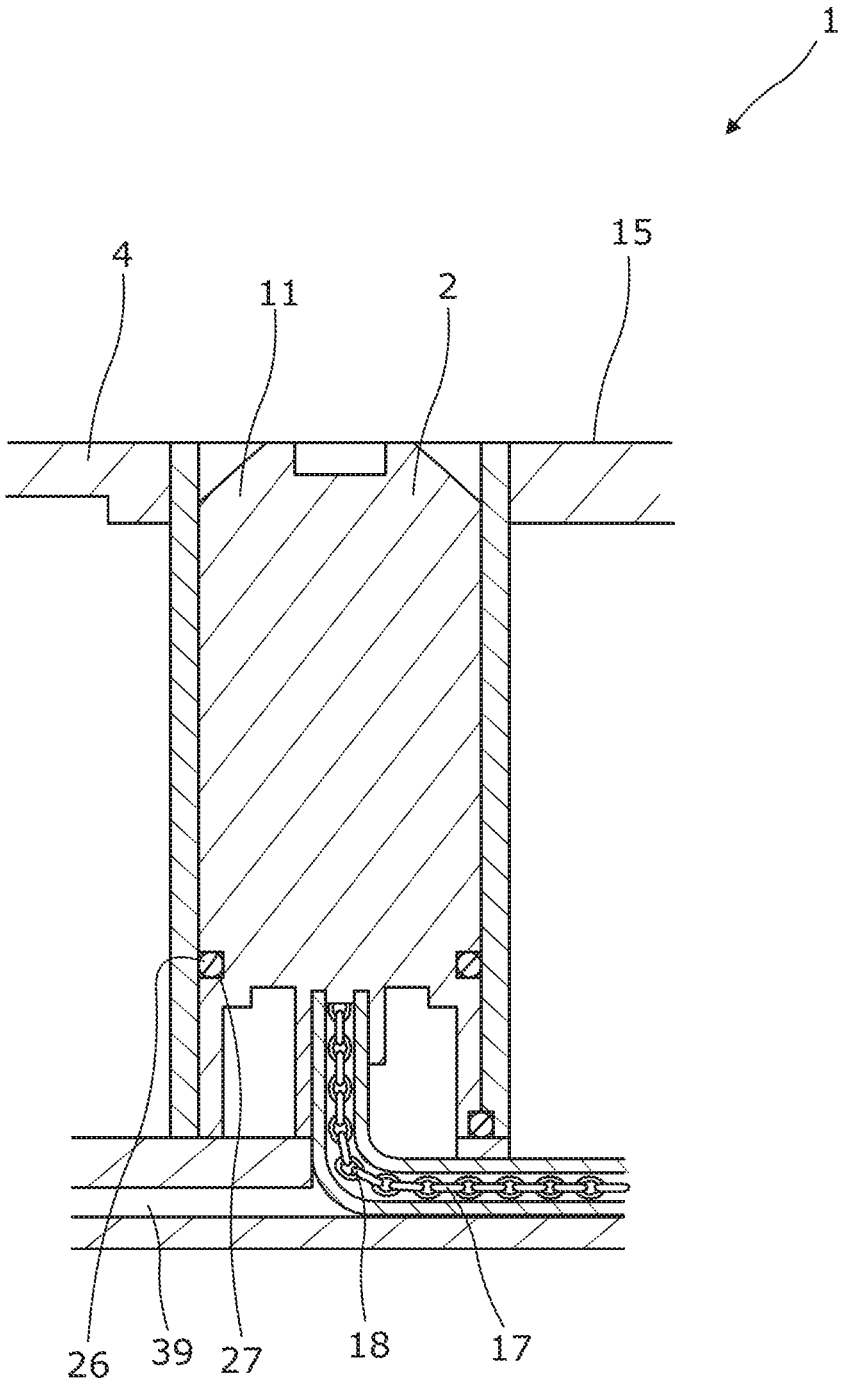
Figure 9:
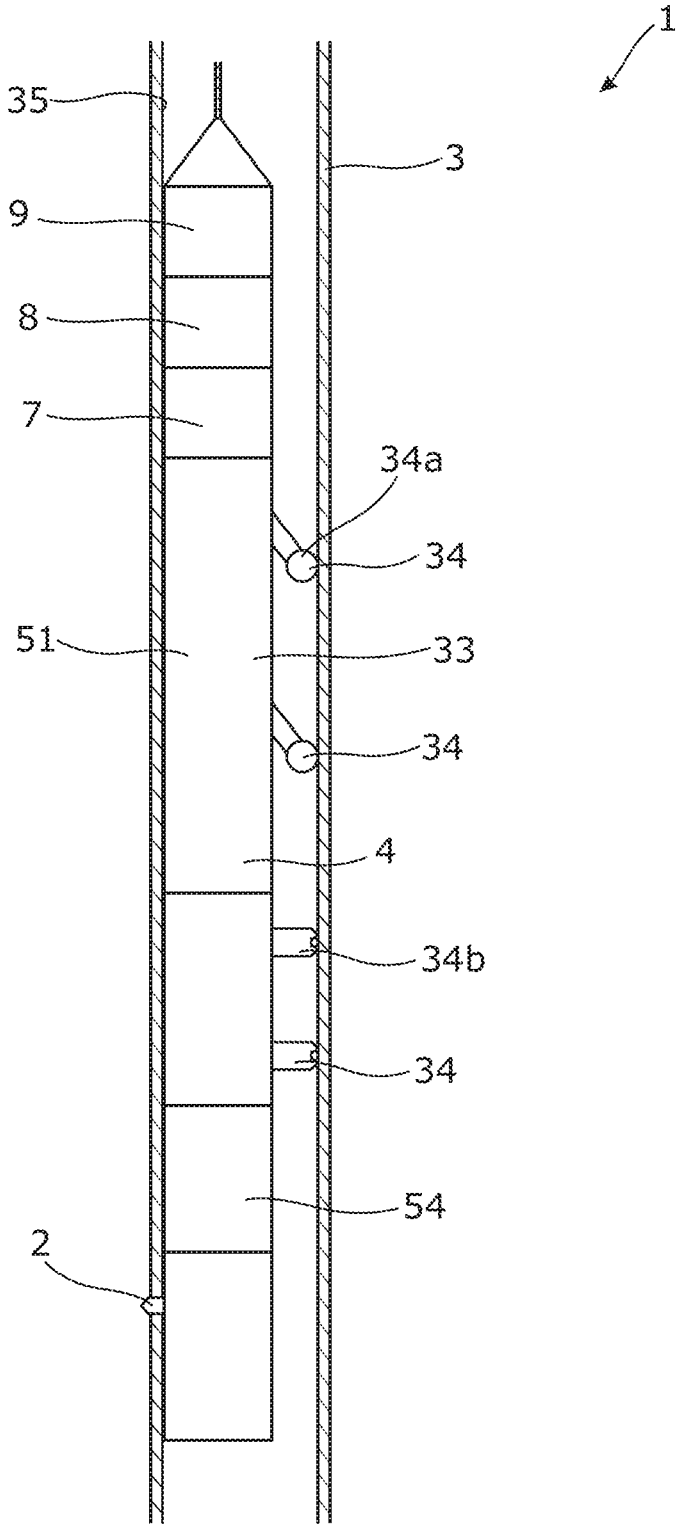

The invention and its many advantages will be described in more detail below with reference to the accompanying schematic drawings, which for the purpose of illustration show some non-limiting embodiments and in which FIG. 1 shows a downhole operational tool in a well, FIG. 2 shows a cross-sectional view of part of a downhole operational tool along the axial extension, FIG. 3 shows a cross-sectional view along the axial extension of part of another downhole operational tool having several tuning points, FIG. 4 shows a cross-sectional view along the axial extension of part of yet another downhole operational tool having a spring element parallel to the radial extension of the tool, FIG. 5 shows a cross-sectional view of part of another downhole operational tool having a rotation unit, FIG. 6 shows a cross-sectional view transverse of the axial extension of part of a downhole operational tool, FIG. 7 shows a side view of a downhole operational tool, FIG. 8 shows a cross-sectional view of part of another downhole operational tool, and FIG. 9 shows another downhole operational tool which is decentralised in the well.

All the figures are highly schematic and not necessarily to scale, and they show only those parts which are necessary in order to elucidate the invention, other parts being omitted or merely suggested.

FIG. 1 shows a downhole operational tool 1 for moving a tool part 2 between a retracted position and a projected position in a well having a well tubular metal structure 3. The tool part 2 may be a drill bit or a machining bit 2*a*, or an anchor 2*b*. The downhole operational tool 1 comprises a tool body 4 having an axial extension 5, and the tool part 2 is movable perpendicularly to the axial extension between the retracted position and the projected position. The downhole operational tool 1 further comprises a projection actuator 6 configured to project the tool part 2 from the tool body 4 by means of hydraulics provided by means of a pump 7 driven by an electrical motor 8 and an electronic section 9. The tool part is shown in its projected position in FIG. 1. Thus, the pump 7 is fluidly connected to the projection actuator 6 via a fluid line 39 (shown in FIG. 8).

In FIG. 2, the projection actuator 6 comprises an actuator housing 10 and a projection piston 11 configured to slide inside the actuator housing. The tool part 2 is connected with the projection piston 11, and the projection actuator 6 thus slides the tool part 2 out of the actuator housing 10 from the retracted position to the projected position. The tool part is shown in its retracted position in FIG. 2. The downhole operational tool 1 further comprises a retraction actuator 12 which retracts the tool part 2. The retraction actuator 12 comprises a spring element 14 configured to retract the tool part 2 into the tool body 4. The retraction actuator 12 is connected with the projection piston 11 so that when the projection actuator 6 projects the tool part 2, the spring element 14 is compressed. The tool part 2 projects substantially perpendicularly to the axial extension at a distance d (shown in FIG. 6) from an outer face 15 of the tool body 4. In order to project the tool part 2, part of the projection actuator 6 takes up some of the space in the tool body 4. Due to the fact that the spring element 14 of the retraction actuator 12 is arranged outside the actuator housing 10 the spring element does not occupy space in the actuator housing which would limit the projection of the tool part and hereby the projection of the tool part 2 is not limited in projection to make room for the spring element.

As shown in FIG. 2, the retraction actuator 12 comprises a retraction piston 16 configured to compress the spring element 14 upon projection of the tool part 2, and the retraction piston is thus connected with the projection piston 11 by means of an elongated element 17. The elongated element 17 is bendable around a turning point 18 so that when the projection piston 11 is forced radially outwards in the actuator housing 10 by the hydraulic fluid from the pump, the elongated element 17 pulls in the retraction piston 16. The turning point 18 is provided by a bearing 19 around which the elongated element 17 turns. As the retraction piston 16 moves towards the actuator housing 10, the spring element 14 is compressed, thereby providing a retraction force. By arranging the spring element 14 outside the actuator housing 10, the spring element 14 can be designed to be very powerful, without being limited in space, to provide a high retraction force, which may be needed, e.g. if the tool part 2 is a punch 2*c* or a machining bit which, when machining, may get stuck and thus requires a high retraction force in order for the downhole operational tool 1 to be able to pull the tool part 2 and be retracted from the well. The elongated element 17 is a wire which is strong when pulling but still bendable so as to be able to run around the bearing 19 and connect the retraction piston 16 with the projection piston 11.

The spring element 14 has a spring axis 20 which extends along and is parallel with the axial extension 5. The spring element 14 is a coiled spring, but may be any other suitable spring element. The retraction actuator 12 comprises a piston housing 21 in which the retraction piston 16 and the spring element 14 are arranged so that when the retraction piston moves towards the actuator housing 10, the spring element is squeezed in between the piston housing 21 and the retraction piston 16. The retraction piston 16 divides the piston housing 21 into a first housing part 22 and a second housing part 23. The first housing part 22 comprising the spring element 14 and the second housing part 23 has an opening 24 which is in fluid communication with the well so that when the projection piston 11 moves, thereby pulling in the retraction piston 16, the second housing part 23 increases, and well fluid is sucked into the second housing part 23 through a fluid channel 25. The pistons 11, 16 comprise sealing elements 26 arranged in a groove 27 in the pistons.

The downhole operational tool 1 further comprises a measuring unit 28 configured to measure a position of the tool part 2 and thereby also measure when the operation is completed if the operation is a machining operation, such as punching or drilling a hole in the well tubular metal structure. The measuring unit 28 is configured to measure a position of the retraction piston 16 and thereby the position of the tool part 2 because the elongated element 17 is rigid, and thus, the movement of the retraction piston is the same as the movement of the projection piston 11 and thus also the movement of the tool part 2. In FIG. 2, the measuring unit is a coil 28*a* arranged inside the spring element 14, and a centre shaft 29 of the retraction piston 16 extends into the coil. The extension of the centre shaft 29 is measured in the coil, and how far the centre shaft extends into the coil is detected by electronics 31 of the measuring unit 28.

As shown in FIG. 3, the downhole operational tool 1 may have several turning points 18 around which the elongated element 17 turns. The several turning points 18 are provided with several bearings 19 around which the elongated element 17 turns. By having several turning points 18, the piston housing 21 can be made with a larger diameter, and the pull in the retraction piston can be arranged to be in the centre of the retraction piston 16 and not in the periphery of the piston, as shown in FIG. 2. The position of the retraction piston 16 is measured by the measuring unit 28 arranged in the piston housing 21. The tool part 2 shown in FIG. 3 is an anchor 2*d* which may also function as a key engaging a sliding sleeve for moving the same.

The spring element 14 shown in FIG. 4 has a spring axis 32 which is substantially perpendicular to the axial extension 5. The elongated element 17 runs around two turning points 18 arranged around two bearings and is fastened to the retraction piston 16. The retraction piston 16 is arranged in the piston housing 21 and compresses the spring element 14 when the projection piston is forced to project the tool part 2, in the same way as described above. The tool part is a punch 2*c*.

In FIG. 8, the elongated element 17 is a chain running in a tubular element having a bend, and the bend forms the turning point 18. The elongated element may in another embodiment be a strip made of spring metal.

In FIG. 9, the downhole operational tool 1 further comprises a support section 33 having projectable elements 34 for moving the tool body 4 and the tool part 2 towards an inner face 35 of a well tubular metal structure 3 in the well so that the tool part 2 comes closer to the well tubular metal structure in which it is to operate. As shown, the projectable element 34 may be an arm, such as a wheel arm 34*a* and/or an anchor 34*b* for pressing the tool body 4 towards the inner face 35 of the well tubular metal structure 3. The downhole operational tool 1 may also have projectable elements 34 for centralising the tool body 4 in the well tubular metal structure and/or supporting the tool providing a backstop when operating.

In FIG. 5, the downhole operational tool 1 further comprises a rotation unit 40 configured to rotate the actuator housing 10 to rotate the tool part 2. The tool part is a machining bit 2*a*, which is able to drill into the well tubular metal structure and machine a hole. The rotation unit 40 comprises a toothed shaft 41 and an electrical motor 42 for rotating the toothed shaft 41. The actuator housing 10 comprises a toothed rim 43 extending all the way around the actuator housing and engaging the toothed shaft 41 rotated by the electrical motor of the rotation unit 40. Bearings 19*b* are arranged between the actuator housing 10 and the tool body 4. Thus, the projection piston 11 is configured to rotate along with the actuator housing 10 and rotate the tool part 2 while also being slidable therein to project the tool part 2. The tool part 2 is projected by means of pressurised fluid from the pump and is rotated by the electrical motor 42 of the rotation unit 40. The tool part 2 may be projected before the rotation is initiated. The fluid is supplied to the projection actuator 6 through an actuation fluid channel 44 and presses against the projection piston 11 to move the same. The machining bit may be round at the end facing the casing or the well tubular metal structure and thus has no cutting edge, and the bit may be made of tungsten carbide and be rotated at a high speed, forcing its way through the casing or through the well tubular metal structure.

The actuator housing 10 has a round and/or circular outer cross-sectional configuration with an oval inner bore 45 matching an oval shape of the projection piston 11, when seeing the tool in side perspective viewing the outer face 15 and the tool part 2, as shown in FIG. 7. The oval configuration of the projection piston 11 and the inner bore 45 transfers the rotation of the actuator housing 10 to the projection piston 11. The actuator housing 10 is round and is rotated by the toothed shaft.

As seen in FIG. 6, the downhole operational tool 1 rotating the tool part 2 has an actuator housing 10 made with a toothed rim, and in FIG. 5, the toothed rim is fastened to an outside of the actuator housing 10. The elongated element 17 is fixedly connected to a connection part 47 engaging the projection piston 11. The projection piston 11 comprises a second piston part 48 arranged under the connection part 47 so that the connection part 47 is prevented from sliding away from the projection piston 11. The projection piston 11 is configured to rotate in relation to the connection part 47, and the connection part does not rotate, as that would twist the elongated element 17. The connection part 47 thus slides along with the projection piston 11 when the tool part 2 is projected, but the connection part 47 remains still while rotating the actuator housing 10 and the tool part 2. In this way, the elongated element 17 is not twisted while rotating the piston 11, but still moves radially outwards with the projection piston 11. A circumferential bearing 49 is arranged between the connection part 47 and the second piston part 48 to reduce the friction therebetween. The circumferential bearing 49 is a needle bearing. The tool part 2 is a hollow drill having a central bit 52 and a circumferential rim 53 for cutting a piece out of the casing or out of the well tubular metal structure. The central bit 52 has a projection 58 so that the piece is fastened inside the hollow drill and retracted along with the tool part 2.

By arranging the spring element outside the actuator housing 10, the tool part 2 is able to project further from the outer face 15 of the tool body 4 than in prior art tools. In FIG. 6, the tool body 2 of the downhole operational tool has a tool diameter D, and the outer face 15 and the tool part 2 are able to project at a distance d from the outer face. The distance d is at least 25% of the tool diameter, preferably at least 30% of the tool diameter, and more preferably at least 50% of the tool diameter.

As shown in FIGS. 1 and 9, the downhole operational tool 1 further comprises a driving unit 51 configured to propel the tool forward in the well, and as shown in FIG. 9, the driving unit 51 can also be used to decentralise the tool body 4 and press the tool body towards the well tubular metal structure 3. The downhole operational tool 1 further comprises a detection unit 54 configured to measure a position of the downhole operational tool 1 in relation to the well. In FIG. 1, the downhole operational tool 1 further comprises a rotation unit 55 for rotating a first part 56 of the tool in relation to a second part 57 of the tool. The first part 56 comprises the projection actuator 6 and the retraction actuator 12 and can thus be rotated so that the machining process can be performed at any position along the circumference of the well tubular metal structure 3.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a well tubular metal structure or a casing, such as a production casing, is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole operational tool for moving a tool part between a retracted position and a projected position in a well, comprising:

a tool body having a longitudinal axis, the tool part being movable along a line that is perpendicular to the longitudinal axis between the retracted position and the projected position, a projection actuator configured to project the tool part from the tool body by means of hydraulics, the projection actuator comprising an actuator housing and a projection piston configured to slide inside the actuator housing, the tool part being connected with the projection piston, and a retraction actuator comprising a spring element configured to retract the tool part into the tool body, the retraction actuator being connected with the projection piston so that when the projection actuator projects the tool part, the spring element is compressed, wherein the spring element is arranged outside the actuator housing; and wherein the retraction actuator comprises a retraction piston configured to compress the spring element, the retraction piston being connected with the projection piston by means of an elongated element, the elongate element being attached to both the projection piston and the retraction piston and reciprocating with both pistons when the tool part is moved between the retracted and projected positions.

2. A downhole operational tool according to claim 1, wherein the spring element has a spring axis extending parallel to the longitudinal axis, such that the spring element is compressed in a direction parallel to the longitudinal axis as the tool part is moved to the projected position.

3. A downhole operational tool according to claim 1, wherein the tool body has a tool diameter and an outer face, the tool part being capable of projecting at a distance from the outer face, the distance being at least 25% of the tool diameter.

4. A downhole operational tool according to claim 1, wherein the actuator housing has a round outer cross-sectional configuration with an oval inner bore matching an oval shape of the projection piston.

5. A downhole operational tool according to claim 1, further comprising a driving unit configured to propel the downhole operational tool forward in the well.

6. A downhole operational tool according to claim 1, further comprising a detection unit configured to measure a position of the downhole operational tool in relation to the well.

7. A downhole operational tool for moving a tool part between a retracted position and a projected position in a well, comprising:

a tool body having a longitudinal axis, the tool part being movable along a line that is perpendicular to the longitudinal axis between the retracted position and the projected position, a projection actuator configured to project the tool part from the tool body by means of hydraulics, the projection actuator comprising an actuator housing and a projection piston configured to slide inside the actuator housing, the tool part being connected with the projection piston, and a retraction actuator comprising a spring element configured to retract the tool part into the tool body, the retraction actuator being connected with the projection piston so that when the projection actuator projects the tool part, the spring element is compressed, wherein the spring element is arranged outside the actuator housing; and wherein the retraction actuator comprises a retraction piston configured to compress the spring element, the retraction piston being connected with the projection piston by means of an elongated element, wherein the elongated element is bendable.

8. A downhole operational tool according to claim 7, further comprising a turning point around which the elongated element turns.

9. A downhole operational tool for moving a tool part between a retracted position and a projected position in a well, comprising:

a tool body having a longitudinal axis, the tool part being movable along a line that is perpendicular to the longitudinal axis between the retracted position and the projected position, a projection actuator configured to project the tool part from the tool body by means of hydraulics, the projection actuator comprising an actuator housing and a projection piston configured to slide inside the actuator housing, the tool part being connected with the projection piston, and a retraction actuator comprising a spring element configured to retract the tool part into the tool body, the retraction actuator being connected with the projection piston so that when the projection actuator projects the tool part, the spring element is compressed, wherein the spring element is arranged outside the actuator housing; and wherein the retraction actuator comprises a retraction piston configured to compress the spring element, the retraction piston being connected with the projection piston by means of an elongated element, further comprising a rotation unit configured to rotate the actuator housing to rotate the tool part.

10. A downhole operational tool according to claim 9, wherein the actuator housing comprises a toothed rim engaging a toothed shaft rotated by the rotation unit.

11. A downhole operational tool according to claim 9, wherein the elongated element is fixedly connected to a connection part, and wherein the projection piston is configured to rotate in relation to the connection part.

12. A downhole operational tool for moving a tool part between a retracted position and a projected position in a well, comprising:

a tool body having a longitudinal axis, the tool part being movable along a line that is perpendicular to the longitudinal axis between the retracted position and the projected position, a projection actuator configured to project the tool part from the tool body by means of hydraulics, the projection actuator comprising an actuator housing and a projection piston configured to slide inside the actuator housing, the tool part being connected with the projection piston, and a retraction actuator comprising a spring element configured to retract the tool part into the tool body, the retraction actuator being connected with the projection piston so that when the projection actuator projects the tool part, the spring element is compressed, wherein the spring element is arranged outside the actuator housing; and wherein the retraction actuator comprises a retraction piston configured to compress the spring element, the retraction piston being connected with the projection piston by means of an elongated element, further comprising a measuring unit configured to measure a position of the tool part, wherein the measuring unit is configured to measure a position of the retraction piston and thereby the position of the tool part.

13. A downhole operational tool according to claim 12, wherein the measuring unit is a coil.

* * * * *